US008350242B2

(12) United States Patent
Graves et al.

(10) Patent No.: US 8,350,242 B2
(45) Date of Patent: Jan. 8, 2013

(54) MOLD FOR FORMING A RADIOACTIVE SHIELD COMPONENT AND FOR SHIELDING RADIOACTIVITY

(75) Inventors: Todd L. Graves, Knoxville, TN (US); Craig M. Stuesse, Knoxville, TN (US); Michael P. Roy, Kingston, TN (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 38 days.

(21) Appl. No.: 13/088,538

(22) Filed: Apr. 18, 2011

(65) Prior Publication Data

US 2012/0261597 A1 Oct. 18, 2012

(51) Int. Cl.
*G21C 11/00* (2006.01)

(52) U.S. Cl. ..... 250/518.1; 250/515.1; 250/506.1; 250/507.1; 250/517.1; 250/505.1; 250/492.1; 250/492.2; 250/492.3

(58) Field of Classification Search ..... 250/518.1, 250/515.1, 506.1, 507.1, 517.1, 505.1, 492.1, 250/492.2, 493.3
See application file for complete search history.

(56) References Cited

U.S. PATENT DOCUMENTS

| | | | | |
|---|---|---|---|---|
| 4,123,392 | A | 10/1978 | Hall et al. | |
| 5,225,114 | A * | 7/1993 | Anderson et al. | 588/16 |
| 6,372,157 | B1 * | 4/2002 | Krill et al. | 252/478 |
| 6,777,700 | B2 * | 8/2004 | Yanagisawa et al. | 250/492.3 |
| 6,960,311 | B1 | 11/2005 | Mirsky et al. | |
| 7,250,119 | B2 | 7/2007 | Sayala | |
| 7,449,131 | B2 | 11/2008 | Hayner et al. | |
| 7,553,431 | B2 | 6/2009 | Hayner et al. | |
| 2002/0162282 | A1 * | 11/2002 | Mittermaier et al. | 52/102 |

* cited by examiner

*Primary Examiner* — Jack Berman
*Assistant Examiner* — Meenakshi Sahu
(74) *Attorney, Agent, or Firm* — Peter Kendall

(57) ABSTRACT

A shield for absorbing radiation emitted during generation of a radioisotope. The shield includes an inner portion fabricated from a first type of shielding material. The shield also includes an outer portion fabricated from a second type of shielding material wherein the outer portion serves as a mold for forming the inner portion. The inner portion may be fabricated from a material which shields against gamma rays such as concrete. The outer portion may be fabricated from a material which moderates neutrons such as high density polyethylene. Additional shielding materials may be embedded into the inner portion as desired.

22 Claims, 2 Drawing Sheets

MOLD FOR FORMING A RADIOACTIVE SHIELD COMPONENT AND FOR SHIELDING RADIOACTIVITY

FIELD OF THE INVENTION

This invention relates to radioactive shields used with particle accelerators, and more particularly, to a mold for forming a radioactive shield component and for shielding radioactivity.

BACKGROUND OF THE INVENTION

Positron Emission Tomography (PET) is a procedure used for imaging and measuring physiologic processes within the human body. As part of the procedure, radioisotopes are injected into a patient to assist in diagnosing and assessing a disease. A radioisotope, such as Fluorine-18, may be produced through the use of a particle accelerator. In particular, the particle accelerator produces radioisotopes by accelerating a particle beam and bombarding a target material, housed in a target system, with the particle beam. Referring to FIGS. 1*a* and 1*b*, a general configuration for a particle accelerator 10 is shown. The particle accelerator 10 generates a particle beam 12 within movable concrete shields 14 and 16 and stationary concrete shields 18 and 20. The particle beam 12 then bombards target material 11 inside target enclosure 22 to produce a radioactive isotope. The resulting decay of the isotope as well as other interactions generate gamma rays and neutron particles 13 that are absorbed by the concrete shields 14, 16, 18,20 to protect any person located in areas outside of the concrete shields 14, 16, 18,20.

High density materials are used to shield a particle accelerator in order to reduce the energy from accelerated particles in the shortest distance possible. The effectiveness of a material in reducing energy or slowing down particles varies with different types of particles and their energy level. Concrete is typically used for shielding many types of radiation including gamma rays and neutron particles and is used extensively in the nuclear industry. In particular, the concrete shields 14, 16, 18,20 are made of concrete formed through use of a steel mold that is supported by reinforcement ribs. Additional shielding materials may also be mounted to the concrete shields 14, 16, 18,20 to improve the performance of the concrete shields. Reinforced steel and wood forms are typically used to mold the concrete used in stationary shield components such as walls, floors, and ceilings. In use, the shield components are typically covered with commercial materials such as sheet rock and paint to make their appearance more cosmetically acceptable. However, such commercial materials are labor intensive to use and lack durability.

In low energy cyclotrons and linear particle accelerators moveable concrete shields may be used in a self-shielded configuration. In these applications individual concrete pieces are also formed using steel molds. However, the molding process produces parts with poor surface finishes that require a great deal of manual labor to repair in order to produce a cosmetically acceptable surface. In addition, the resulting surface is brittle and is easily damaged when the steel mold is removed from the concrete and during the manufacturing, assembly, shipping and installation process. This requires constant repair of the damaged surfaces with the use of common filler materials, sheet rock mud and other repair materials in order to maintain the cosmetic appearance of the surfaces. However, such repair materials do not provide the same strength and shielding properties as concrete.

Concrete also has other structural limitations. Concrete has excellent compressive strength but is very weak in tension. These tensile strength limitations require that all concrete structural members be reinforced with steel reinforcement members 38 such as steel rebar in areas where the concrete structural members experience tensile loads. Use of steel to provide reinforcement is an undesirable feature in concrete radiation shields. The steel reinforcement members 38 become radioactive when acted upon by neutron particles 13 produced from the interaction of particle accelerator beam 12 on target material 11 inside target enclosure 22 whereas the surrounding concrete material does not. Thus, the reinforcement members 38 require additional shielding in the concrete shield. In addition, the steel reinforcement members 38, when radioactive, pose increased disposal cost to the customer when the particle accelerator is decommissioned at its end of life.

Further, the steel molds are subjected to frequent flexing, bending and movement during the fabrication of the concrete shields which quickly fatigues and damages the steel molds. As a result, the steel molds require frequent maintenance which increases costs. Moreover, the maintenance is labor intensive which further increases costs.

The manufacturing process for the concrete shields 14, 16, 18,20 takes place at the manufacturers' facility. The concrete shields 14, 16, 18,20 are then shipped to a customer location. The steel molds, on the other hand, are kept at the manufacturers' facility because their size and weight make them cost prohibitive to ship.

Therefore, new techniques are needed for casting shield components that reduce costs, are less labor intensive and result in shields that are cosmetically acceptable, provide enhanced structural characteristics and are durable and functional.

SUMMARY OF THE INVENTION

A shield for absorbing radiation emitted during generation of a radioisotope is disclosed. The shield includes an inner portion fabricated from a first type of shielding material. The shield also includes an outer portion fabricated from a second type of shielding material wherein the outer portion serves as a mold for forming the inner portion. The inner portion may be fabricated from a material which shields against gamma rays such as concrete. The outer portion may be fabricated from a material which moderates neutrons such as high density polyethylene. In the case of concrete shields, the material is structurally reinforced using a structural member that does not become radioactive in radiation fields.

DESCRIPTION OF THE INVENTION

Figure 1A:
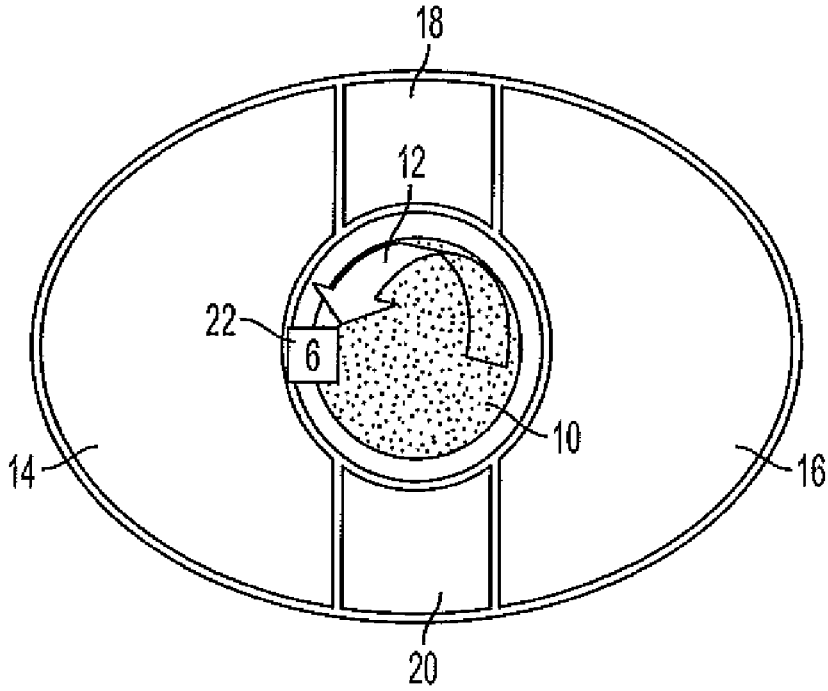
FIGS. 1*a* and 1*b* depict a general configuration for a particle accelerator and associated shielding and the general interaction between a particle beam and target materials.
Figure 1B:
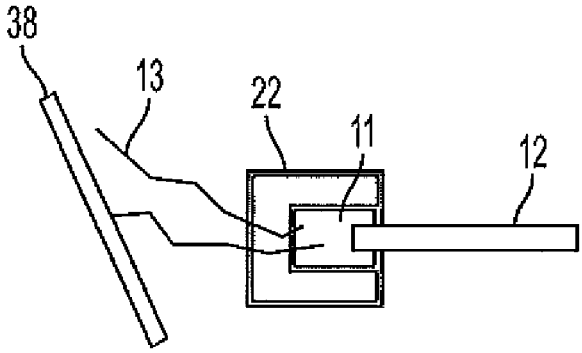

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings. In the description below, like reference numerals and labels are used to describe the same, similar or corresponding parts in the several views of FIGS. 1-2.

Figure 2:
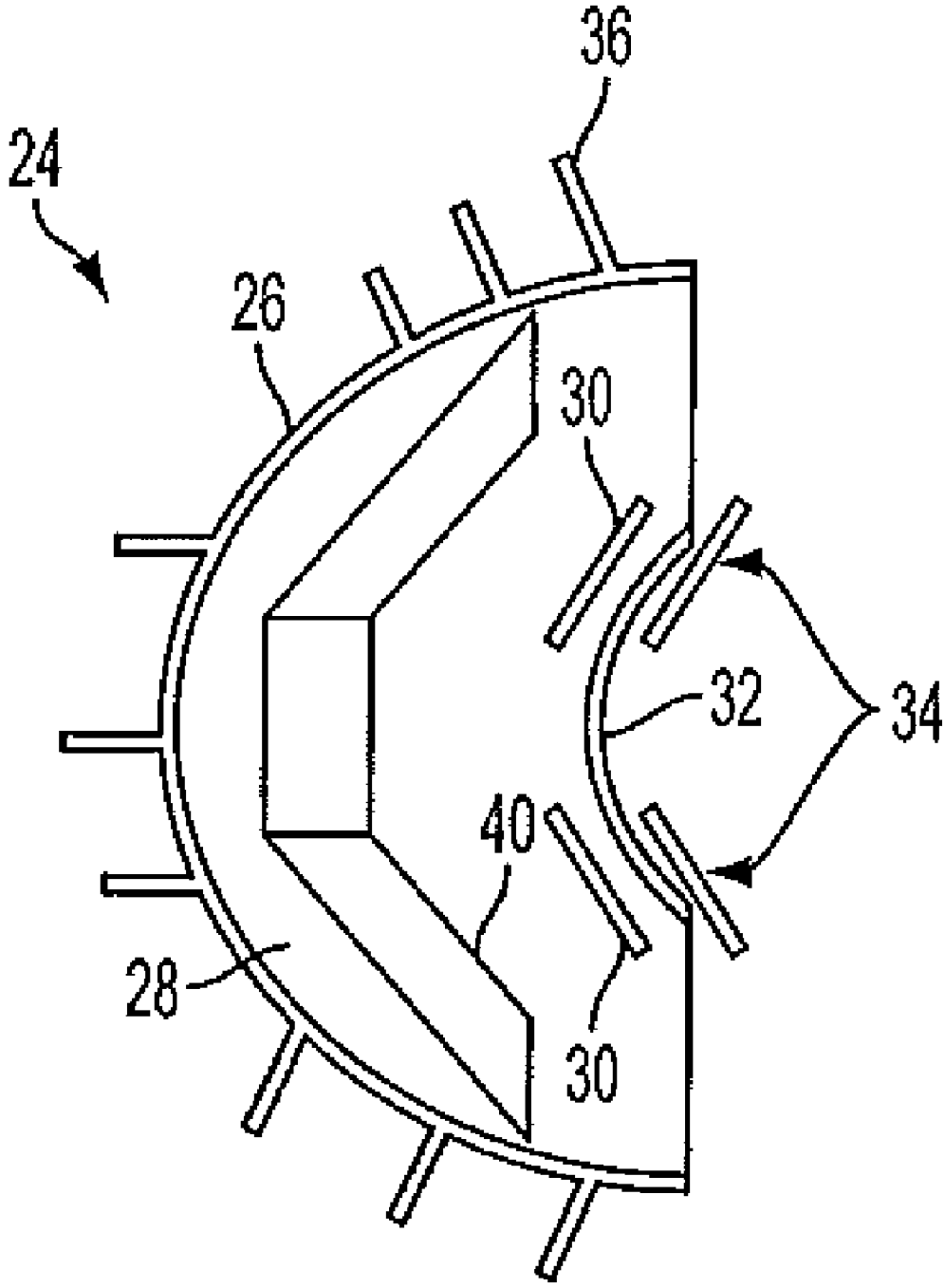
FIG. 2 depicts a portion of a shield configured in accordance with the present invention.

Referring to FIG. 2, a portion of a shield 24 configured in accordance with the present invention is shown. The shield 24 includes a polyethylene portion 26 located on an outer periphery of an inner concrete portion 28. Polyethylene is a good neutron moderator and reflector and thus the polyethylene portion 26 serves as a shielding component along with the concrete portion 28 in the shield 24. In accordance with the present invention, the polyethylene portion 26 also serves as a mold for forming the concrete portion 28 of the shield 24. The concrete portion 28 includes a curved surface 32 for accommodating a portion of a particle accelerator. The particle accelerator is used to generate radioisotopes by accelerating a particle beam and bombarding a target material, housed in a target system, with the particle beam. The shield 24 may be configured for use in a self-shielding particle accelerator arrangement that uses a low energy particle accelerator. In this arrangement, the shield 24 may be configured to be moveable.

The polyethylene portion 26 may be formed by an injection molding or a blow molding process. In a preferred embodiment, the polyethylene portion 26 is formed by rotation molding (i.e. "rotomolding"). The injection molding, blow molding and rotomolding processes all provide continuous walls in the polyethylene portion 26 that are suitable for molding the concrete portion 28. In addition, the thickness of polyethylene portion 26 may be varied as desired by using either process. Polyethylene is an inexpensive material with many desirable properties suitable for molding concrete. In particular, polyethylene is cosmetic, durable, repairable, readily colored to meet customer requirements, has good strength properties in addition to being a neutron moderator and reflector. In one embodiment, ribs 36 are used to provide support for the polyethylene portion 26.

The polyethylene portion 26 may also be blended with other materials suitable for increasing the material shielding properties without significantly affecting the structural properties of the material. In addition, shielding components 30 and 40 may be embedded in the concrete portion 28 to improve the structural or attenuation properties of the shield 24. In a preferred embodiment, the shielding components 30 may be fabricated from lead or polyethylene and structural components 40 may be fabricated from fiberglass. Alternatively, the shielding components 30 and structural components 40 may be fabricated from steel. Use of polyethylene in the concrete portion 28 and fiberglass structural components 40 have the added benefit that the amount of radioactive shielding that has to be disposed is reduced when the system is decommissioned. Additional shielding elements 34 may be located adjacent to surface 32 to provide further shielding capability.

The polyethylene portion 26 is much lighter than conventional steel molds. This enables shipment of the polyethylene portion 26 to the customer. The concrete portion 28 is then fabricated at or near the installation site thus substantially reducing costs as compared to shipping a conventional concrete shield. In addition, costs for post processing to repair damaged surfaces are also substantially reduced. Moreover, the supplier is then able to provide customized mold arrangements for fabricating customized shields 24 suitable for the customer.

In a preferred embodiment the polyethylene portion 26 is fabricated from polyethylene such as high density polyethylene (HDPE), low-density polyethylene (LPDE) and linear low-density polyethylene (LLPDE). However, polyvinyl chloride (PVC), fluorocarbons, polypropylene, nylon and polycarbonate or other blends or combinations thereof may also be used. The polyethylene portion 26 may be repaired using unprocessed HDPE powder and simple heating tools such as soldering irons and butane torches.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations.

What is claimed is:

1. A shield for absorbing high level radiation emitted during generation of a radioisotope, comprising:

an inner portion fabricated from a first type of shielding material for shielding against a first type of high level radiation; and an outer portion fabricated from a second type of shielding material for shielding against a second type of high level radiation wherein the inner and outer portions are part of a shield arrangement adapted to shield against high level radiation and wherein the outer portion serves as a mold for forming the inner portion.

2. The shield according to claim 1 wherein the inner portion is fabricated from concrete.

3. The shield according to claim 1 wherein the outer portion is fabricated from high density polyethylene.

4. The shield according to claim 1 wherein additional shielding elements different from the first type of shielding material are embedded in the inner portion and wherein the shielding elements also reinforce the inner portion and do not become radioactive due to generation of the radioisotope.

5. The shield according to claim 4 wherein the shielding elements are fabricated from fiberglass.

6. The shield according to claim 1 further including additional shielding materials located adjacent to the inner portion.

7. The shield according to claim 1 wherein outer portion is formed by using a rotomolding process.

8. The shield according to claim 1 wherein the outer portion is formed by using a blow molding or an injection molding process.

9. The shield according to claim 1 further including ribs for supporting the outer portion.

10. The shield according to claim 1 wherein the radiation is generated by accelerating a particle beam and bombarding a target material with the particle beam.

11. The shield according to claim 1 wherein the inner portion shields against gamma rays.

12. The shield according to claim 1 wherein the outer portion moderates neutrons.

13. A particle accelerator system, comprising:

a particle accelerator for generating a particle beam that bombards a target to generate a radioactive isotope wherein high level radiation is produced during generation of the radioisotope; and a shield used as part of a shield arrangement for absorbing high level radiation emitted during generation of the radioisotope wherein the shield includes an inner portion fabricated from a material which is adapted to shield against gamma rays and an outer portion fabricated from a material which is adapted to moderate neutrons wherein the outer portion serves as a mold for forming the inner portion.

14. The shield according to claim 13 wherein the inner portion is fabricated from concrete.

15. The shield according to claim 13 wherein the outer portion is fabricated from high density polyethylene.

16. The shield according to claim 13 wherein additional shielding elements having shielding properties different from that of the inner portion are embedded in the inner portion and wherein the shielding elements also reinforce the inner portion and do not become radioactive due to generation of the radioisotope.

17. The shield according to claim 16 wherein the shielding elements are fabricated from fiberglass.

18. The shield according to claim 13 further including additional shielding materials located adjacent to the inner portion.

19. The shield according to claim 13 wherein outer portion is formed by using a rotomolding process.

20. The shield according to claim 13 wherein the outer portion is formed by using a blow molding or an injection molding process.

21. The shield according to claim 13 further including ribs for supporting the outer portion.

22. A method for forming a shield for absorbing high level radiation emitted during generation of a radioisotope, comprising the steps of:

providing an outer portion of the shield, wherein the outer portion is fabricated from a first type of shielding material for shielding against a first type of high level radiation, and;

using the outer portion to form an inner portion of the shield, wherein the inner portion is fabricated from a second type of shielding material for shielding against a second type of high level radiation wherein the inner and outer portions are part of a shield arrangement adapted to shield against high level radiation.

* * * * *